United States Patent [19]

Hauser

[11] 4,451,202

[45] May 29, 1984

[54] AXIAL COOLING FAN FOR INTERNAL COMBUSTION ENGINES

[75] Inventor: Kurt Hauser, Stuttgart, Fed. Rep. of Germany

[73] Assignee: Sueddeutsche Kuehlerfabrik, Julius Fr. Behr GmbH & Co. KG, Stuttgart, Fed. Rep. of Germany

[21] Appl. No.: 104,986

[22] Filed: Dec. 18, 1979

[30] Foreign Application Priority Data

Dec. 23, 1978 [DE] Fed. Rep. of Germany ..... 2855909

[51] Int. Cl.[3] ..... F01D 5/12; F01D 5/34; B23P 15/02

[52] U.S. Cl. ..... 416/214 R; 416/244 R; 416/245 R; 123/41.11; 29/156.8 R

[58] Field of Search ..... 416/214 R, 244 R, 245 R, 416/188, 185; 123/41.11, 41.63, 41.65; 29/156.7 P, 156.7 R, 156.8 CF

[56] References Cited

U.S. PATENT DOCUMENTS

| | | | |
|---|---|---|---|
| 40,998 | 12/1863 | Emmick | 164/47 |
| 677,101 | 6/1901 | Parker | 416/244 B |
| 1,402,539 | 1/1922 | Ross | 416/245 |
| 1,426,301 | 8/1922 | Leoni | 123/41.65 |
| 2,270,574 | 1/1942 | Bahr | 416/214 |
| 2,270,650 | 1/1942 | Crocella | 416/214 |
| 2,292,115 | 8/1942 | Frisbie | 416/214 |
| 2,731,193 | 1/1956 | Labb et al. | 29/156.8 CF |
| 3,245,476 | 4/1966 | Rodwick | 416/241 A |
| 3,294,315 | 12/1966 | Stewart et al. | 415/213 C |
| 3,727,593 | 4/1973 | Enke | 416/188 |
| 3,819,294 | 6/1974 | Honnold | 416/241 A |

FOREIGN PATENT DOCUMENTS

| | | | |
|---|---|---|---|
| 872816 | 2/1953 | Fed. Rep. of Germany | 416/214 |
| 1428116 | 11/1968 | Fed. Rep. of Germany | 416/214 |
| 1428153 | 11/1968 | Fed. Rep. of Germany | 416/244 |
| 2030021 | 12/1971 | Fed. Rep. of Germany | 416/241 A |
| 1126364 | 11/1956 | France | 416/188 |
| 1133676 | 4/1957 | France | 416/244 |
| 1149937 | 7/1957 | France | 416/241 A |
| 2281042 | 3/1976 | France | 123/41.11 |
| 54-13847 | 2/1979 | Japan | 123/41.11 |
| 55-153894 | 12/1980 | Japan | 416/241 A |
| 260170 | 2/1949 | Switzerland | 416/244 |
| 429958 | 6/1935 | United Kingdom | 416/245 |
| 505078 | 5/1939 | United Kingdom | 416/188 |
| 551556 | 1/1943 | United Kingdom | 416/245 |
| 614074 | 12/1948 | United Kingdom | 416/214 |

OTHER PUBLICATIONS

Design News, Jul. 17, 1972, p. 33.

*Primary Examiner*—William L. Freeh
*Attorney, Agent, or Firm*—Browdy and Neimark

[57] ABSTRACT

A fan wheel or pre-guide wheel for axial or semi-axial air flow, especially for use with the cooling systems of motor vehicles. In order to provide for advantageous stream line flow, the leading surfaces of the fan wheel hub or an upstream pre-guide wheel hub are suitably rounded providing for a generally increasing hub diameter in the direction of the air flow. In order to simplify the casting or extrusion of the fan wheel so configured, the invention provides for a substantially cylindrical or conically decreasing hub diameter in the region of the fan hub lying generally behind each fan blade. For fan hubs of relatively low axial depth, for example with riveted fan blades, the gaps may remain uncovered without detrimental effects on the air stream. In one-piece cast fan wheels or pre-guide wheels, including a central hub and a plurality of vanes mounted thereon, the gaps are suitably covered by, especially, light-weight, unstressed segments which may be part of a single segment ring attached by suitable means to the hub of the fan.

13 Claims, 11 Drawing Figures

AXIAL COOLING FAN FOR INTERNAL COMBUSTION ENGINES

FIELD OF THE INVENTION

The invention relates to cooling fans adapted for axial or semi-axial air flow, including a central hub and a plurality of vanes mounted thereon. The fan may be cast or extruded and may especially be adapted for the use in the cooling systems of internal combustion engines.

BACKGROUND OF THE INVENTION

In known cooling fans, the degree of efficiency is improved by providing an air guiding surface with favorable air flow characteristics. The use of such air flow guides is generally unsuitable in cooling systems for internal combustion engines due to limited axial space. On the other hand, the absence of air guide surfaces causes air flow separation at the upstream side of the fan hub which tends to degrade the air flow rate and the fan efficiency and also tends to increase the noise level.

It is also known in the art to improve the air flow characteristics in the vicinity of the fan hub by incorporating the generally rounded contours of the separate air guide surfaces into the configuration of the fan itself, in particular of the fan hub. This procedure is followed, for example, in the construction of the welded fan wheels of the so-called Schicht blower described, for example, in the publication "Ventilatoren" 5th edition, page 340, Illustration 328, Author: Eck, published 1972 by Springer. In the fan wheels described there, the hub diameter increases in the direction of the air flow.

The very large number of fan wheels required for automobile use dictates their being cast in one piece of light metal (e.g. aluminum) or plastic. The presence of shoulders or undercuts due to the increasing hub diameter requires the casting or extrusion machine tools to employ slide bars between individual fan blades so as to permit the casting of the required configuration. The use of these relatively complicated tools is very expensive. If the part is produced by sand casting, the configuration of the fan necessitates the use of relatively expenseive lost casting cores.

OBJECT AND SUMMARY OF THE INVENTION

It is thus a principal object of the present invention to provide an axial or semi-axial fan wheel (impeller) or pre-guide wheel having a hub contour of favorable configuration with respect to the air flow yet capable of being cast in one piece at relatively low expense yet without requiring extensive axial space for installation.

This and other objects are attained according to the invention by providing a fan wheel in which the hub diameter increases in the space between the fan blades as well as in the space exposed to the air flow while the hub contour in the region lying behind each fan blade is substantially cylindrical or slightly conical with a diameter which decreases in the direction of air flow. This manner of construction makes possible the casting or extrusion of the fan wheel in known and conventional manner without the use of special equipment.

The hub configuration according to the invention creates gaps in the fan region lying behind each blade; the presence of these gaps may result in some degree of air flow disturbance. In cooling fans for motor vehicles, the air flow is generally only partially axial so that the presence of the gaps does not affect the air flow stream lines and may be neglected. If the fans are used for substantially exclusive axial flow, a further feature of the invention provides that the gaps in the hub in the vicinity of the rear portion of each blade are filled or covered by suitably shaped segments whose outer contour is substantially equal to or similar to the neighboring hub surface. The installation of these segments results in a particularly favorable overall contour of the hubs, presenting a diameter which increases in the direction of air flow.

In one preferred exemplary embodiment of the invention, the covering segments are attached to the hub by means of screws or rivets. Inasmuch as the segments are not subject to the stresses exerted on the fan blades, they may be produced by casting of relatively thin-walled plastic or light metal parts.

In a modification of the invention, the segments may be attached to the fan hub by means of mating gear teeth and/or suitable guides, for example, dove-tail guides.

In a further embodiment of the invention, the covering segments are part of a support ring consisting of sheet metal, an aluminum casting or plastic and the carrier ring is centered and attached to the fan hub. The carrier ring may also be of relatively thin-walled and light construction due to its being unstressed.

The features of the invention are generally applicable to fan wheels or air guide devices for axial or semi-axial air flow with hub diameters increasing in the direction of air flow. However, they are also suitable for any other desirable hub contour, for example the conventional conical hub contour employed in semi-axial fans.

The invention is also applicable for use on fan wheels with a cast hub having a plurality of stubs to which fan blades made of sheet metal are attached, for example by riveting.

The invention is especially useful for situations in which the available axial volume is limited, for example in air blowers used for motor vehicle compartment heaters and air conditioning systems.

Still further advantages and features of the invention will be discussed in the preferred exemplary embodiments described below which relate to the drawing.

THE DRAWING

DESCRIPTION OF THE PREFERRED EMBODIMENTS

Figure 1:
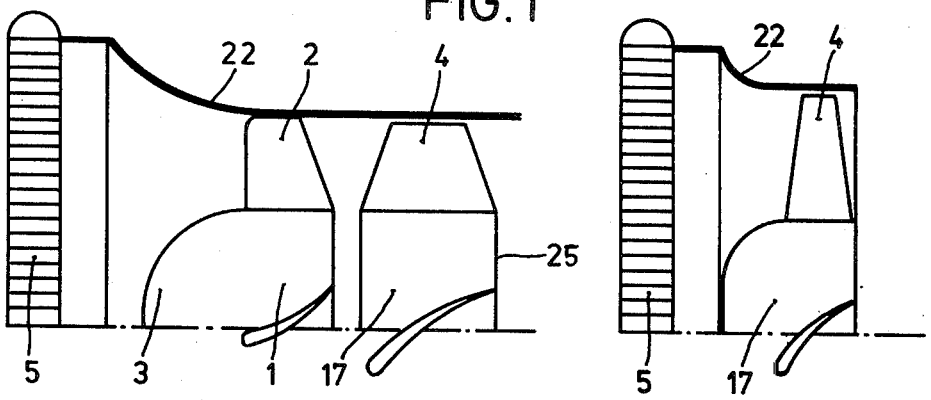
PRIOR ART FIG. 1
FIG. 1 is an illustration of a partial section of a fan wheel including an air guide device in the left half of the figure and a fan without an air guide device in the right half of the figure.

Illustrated in the left half of FIG. 1 is a part of a conventional air blower system for motor vehicles. The system includes a heat exchanger 5 behind which is disposed an air guide wheel or device 1 having a hub 3 and air guide blades 2. Downstream thereof is located a fan wheel 25 having fan blades 4 mounted on a hub 17. The fan wheel 25 which is driven by an internal combustion engine, not shown, aspirates air through the heat exchanger 5. The air guide wheel 1 and the fan wheel 25 are surrounded by a suitable air guide shroud 22. The right half of FIG. 1 illustrates a similar embodiment without the air guide wheel. In this case, the fan wheel 25 is disposed directly downstream of the radiator 5 and is surrounded by the air guide shroud 22. In both instances illustrated in FIG. 1, the upstream part of the hub (the hub of the air guide wheel in the left illustration and the hub of the fan wheel in the right illustration) is rounded so as to present favorable stream lines to the air flow.

Figure 2:
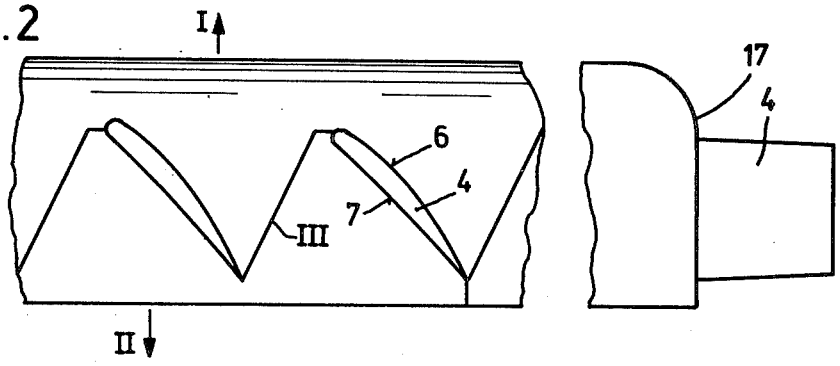
PRIOR ART FIG. 2
FIG. 2 is a schematic diagram illustrating the position of the fan blades in a known configuration.

FIG. 2 is a top view and side view of a known one-piece fan wheel having fan blades 4 which exhibit an upstream surface 6 and a downstream (rear) surface 7. The upstream contour of the hub 17 is shown to be rounded. The fan wheel illustrated in FIG. 2 may be cast or extruded in conventional manner by a tool which is divided at the location III so as to define an upper part I and a lower part II.

Figure 3:
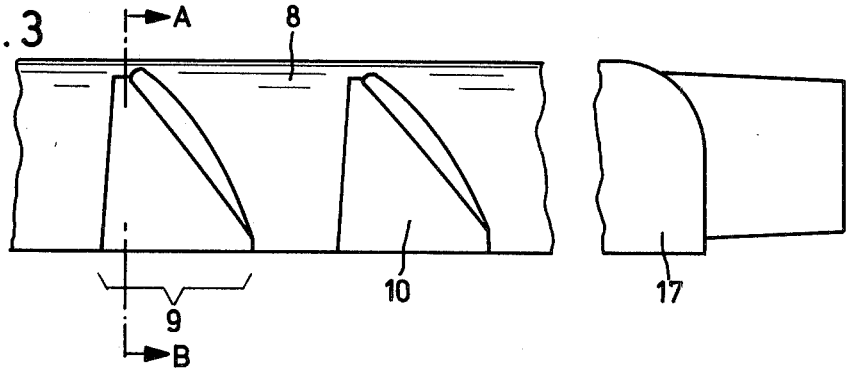
FIG. 3 illustrates the fan wheel according to the invention.
Figure 4:
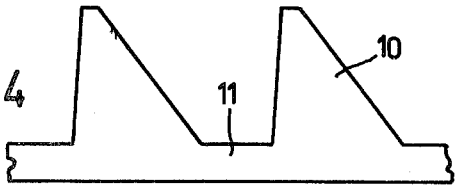
FIG. 4 is an illustration of a gap-covering segment ring.

The features of the invention are illustrated in FIG. 3 which also shows a fan wheel exhibiting an upper hub region 8 and a hub region 9. According to the features of the invention, the hub diameter increases only in the region 8. In the region 9, the hub remains cylindrical or has a slightly conical configuration with a hub diameter which decreases in the direction of air flow. The resulting gaps of the hub region 9 may be covered or filled by segments 10 whose external contour along the section AB is the same as that in the remaining hub region 8 so that the overall surface of the fan hub has the same favorable air flow contour with a diameter that increases in the direction of air flow.

The segments 10 may be attached to the hub 17, for example, by screws or rivets 21. However the segments 10 may also be attached to a segment carrier ring 11 and may be cast or extruded therewith in a single operation. The carrier ring 11 would be located and centered at the rear of the hub and attached by suitable means.

Figure 5:
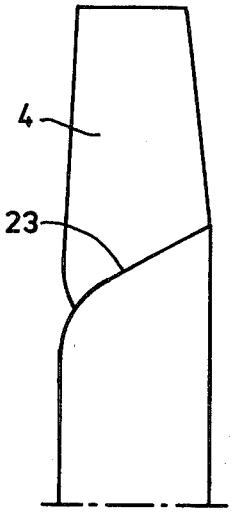
FIG. 5 is a side view of the fan wheel of a semi-axial fan.

FIG. 5 is a side view of a fan wheel for a semi-axial fan with a conical hub 23.

Figure 6:
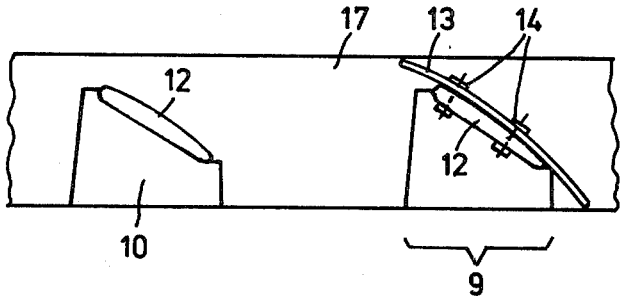
FIG. 6 is an illustration of an embodiment of a fan wheel with riveted blades.
Figure 7:
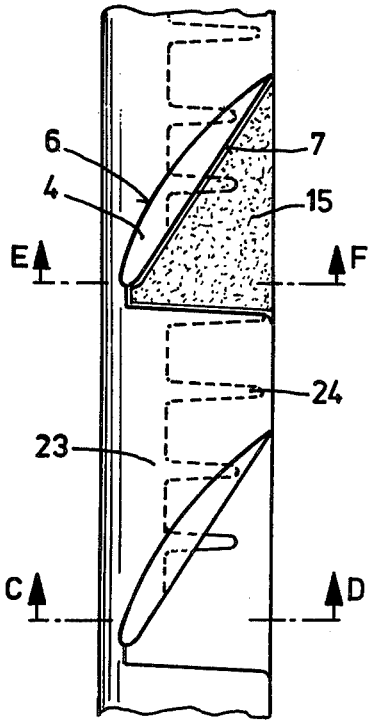
FIG. 7 illustrates an embodiment of the invention with a conical hub.
Figure 8:
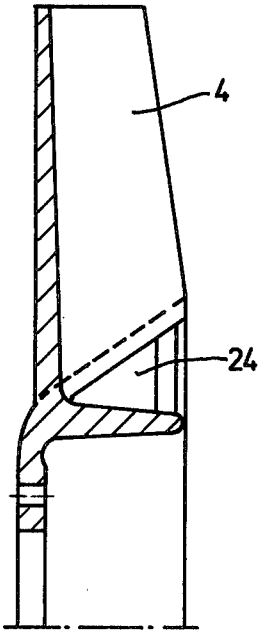
FIG. 8 is a section through the embodiment of FIG. 7 along the line C–D.

FIG. 6 is an illustration of the application of the invention for use with a fan wheel that is composed of a central cast hub 17 having blade stubs 12 to which fan blades 13 are attached by riveting. The relative position of the stubs 12 with respect to the hub 17 is the same as that of the cast blades 4 of previous illustrations. The gaps 9 which occur behind the fan blades 13 are filled by segments 10. Due to the fact that the stubs 12 are generally of smaller axial extent than is the case for one-piece castings, the resulting gaps are also relatively smaller and their detrimental effect on the air flow is thus reduced, making it possible to dispense with the provision of gap-covering segments 10 which further reduces the overall cost. FIGS. 7 and 8 illustrate a fan wheel according to the invention in a one-piece casting with a conical hub 23 which is advantageously rounded to provided for favorable air flow at the upstream side. The fan wheel hub 23 carries cast fan blades 4 exhibiting upstream surfaces 6 and downstream surfaces 7. The hub 23 is reinforced by ribs 24. FIG. 8 is an illustration of a section through the fan wheel of FIG. 7 along the direction C–D with unfilled segments.

Figure 9:
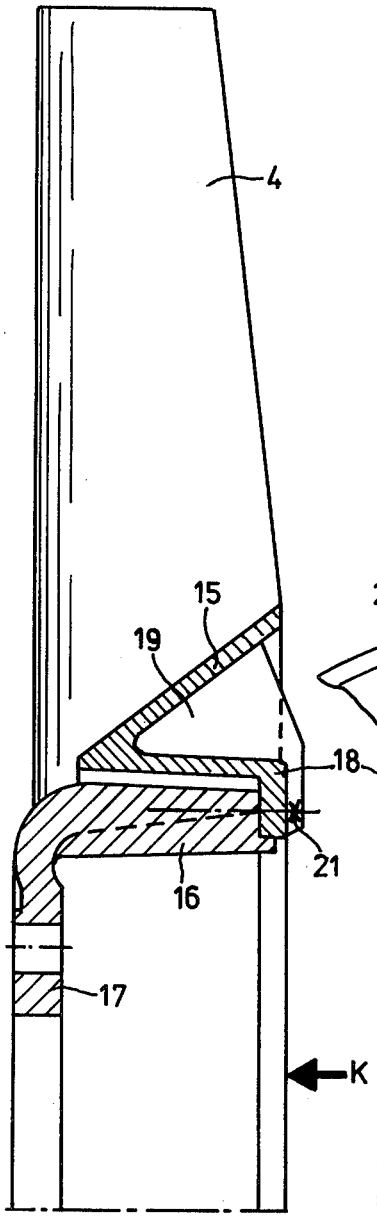
FIG. 9 is a section through the embodiment of FIG. 7 along the line E–F.

FIG. 9 illustrates a section through the embodiment of FIG. 7 along the arrows E–F in which the gaps are filled by segments 15. The segments 15 may be part of a contiguous ring 18 illustrated in FIGS. 9 and 10 centered on cams 16 of the hub 17 and attached there by means of, for example, screws 21. The segments 15 are reinforced by ribs 19 to prevent their yielding under the influence of centrifugal force. The spaces between the segments 15 and the conical part of the fan hub 17 are designated with the numeral 20.

Figure 10:
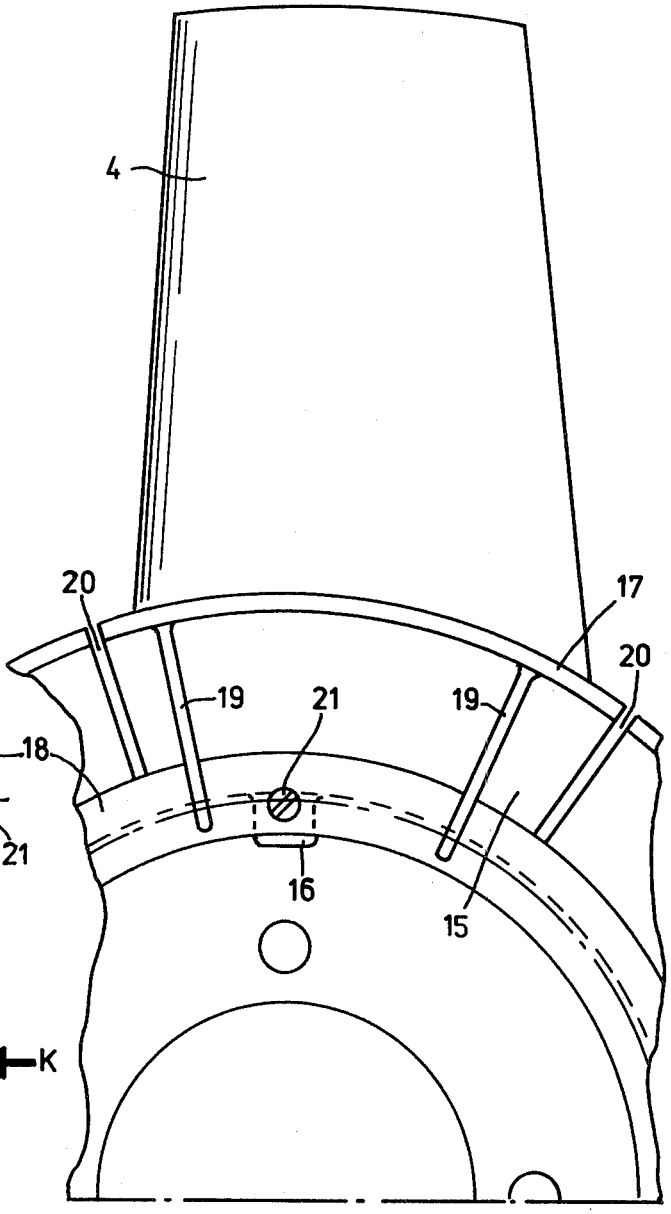
FIG. 10 is a partial rear view of a fan wheel according to the invention with a continuous segment ring and represents the view along the arrow K of FIG. 9.

FIG. 10 is an illustration of the embodiment of FIG. 9 in the direction of the arrow K.

Figure 12:
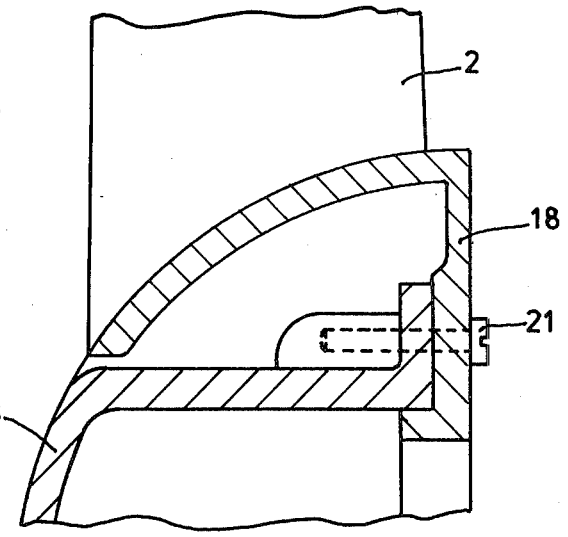
FIG. 12 is a section through the embodiment of FIG. 11.
Figure 11:
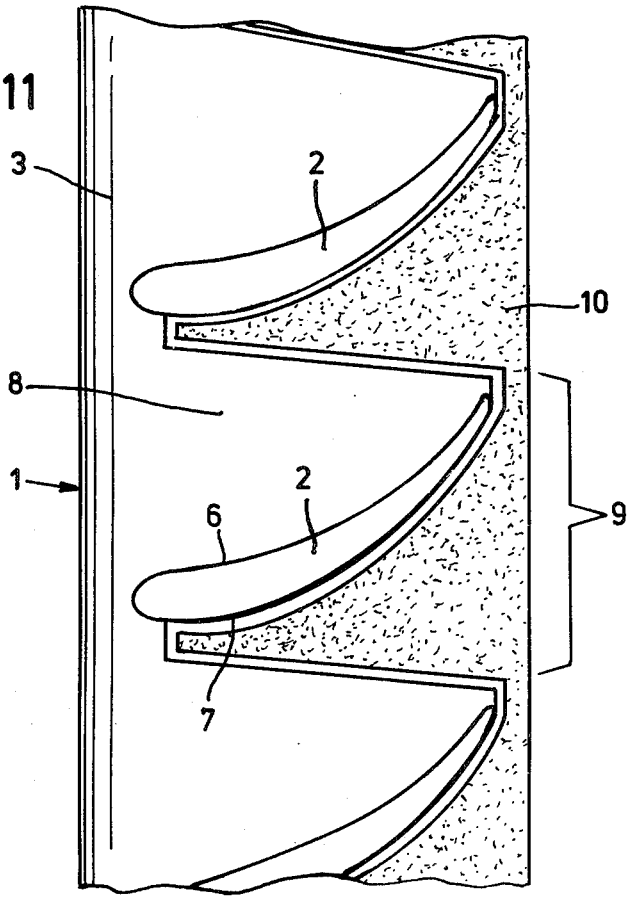
FIG. 11 is a partial view of an air guide device according to the invention.

FIG. 11 is a partial top view and FIG. 12 is a partial section of an air pre-guide wheel 1 according to the invention. The pre-guide wheel 1 is produced in the same manner as the previously described fan wheel so as to make it possible to dispense with lost casting cores and still achieve an increasing hub diameter. The gaps between the air guide blades 2 are filled by segments 10 which may be single elements or may be cast into a ring 18 that is centered on the air guide hub 3 by, for example, screws 21.

The invention has been described with the aid of advantageous but merely exemplary illustrations and embodiments and is subject to changes, variations and combinations of features within the competence of a person skilled in the art without thereby departing from the spirit and scope of the invention.

I claim:

1. A fan wheel or the like, for producing an at least partially axial air flow comprising a hub portion and a blade portion, said hub portion and said blade portion being fabricated integrally in one piece, said blade portion comprising a plurality of at least stub fan blades, said at least stub fan blades being exposed to the air flow through said fan wheel or the like, said hub portion being formed so as to increase in diameter in the portions of said hub portion exposed to the air stream upstream of said at least stub fan blades and to increase in diameter in the regions of said hub portion lying between said at least stub fan blades of said blade portion, said portions of said hub portion between said at least stub blades forming part of the air foil of said hub portion extending between said at least stub blades, the portions of said hub portion downstream of said at least stub blades which are not exposed to the direct air stream through said fan wheel or the like and which are not part of the air foil formed by said hub portion having a contour which is substantially cylindrical, and said substantially cylindrical contour portion of said hub portion and said portion of said hub portion between said at least stub blades joining together upstream of said at least stub blades.

2. A fan wheel or pre-guide wheel according to claim 1, wherein said hub is a casting with a plurality of radially extending stubs to which fan blades are attached by rivets.

3. A fan wheel or pre-guide wheel according to claim 1, wherein the hub portion lying behind said fan blades include gaps which are covered by segments whose outer contours substantially equal the contours of the adjacent hub regions.

4. A fan wheel or pre-guide wheel according to claim 3, wherein said segments are fastened on said hub by means of screws or the like.

5. A fan wheel or pre-guide wheel according to claim 3, wherein said segments are fastened on said hub by means of teeth or guides.

6. A fan wheel or pre-guide wheel according to claim 2, wherein said segments are fastened on said hub by means of mating guides.

7. A fan wheel or pre-guide wheel according to claim 1, wherein said segments are integral with a segment carrier ring, said carrier ring being aligned with and fastened to said hub.

8. A fan wheel or pre-guide wheel according to claim 7, wherein said carrier ring is a unitary element made of sheet metal.

9. A fan wheel or pre-guide wheel according to claim 7, wherein said carrier ring is a unitary element made of plastic.

10. A fan wheel or pre-guide wheel according to claim 7, wherein said carrier ring is a unitary element cast from a light metal.

11. A fan wheel or the like for producing an at least partially axial air flow comprising two members including a first member having a hub portion and a blade portion, said hub portion and blade portion being fabricated integrally in one piece in said first member, said blade portion comprising a plurality of at least stub fan blades, said at least stub fan blades being exposed to the air flow through said fan wheel or the like, said hub portion being formed so as to increase in diameter in the portions of said hub portion exposed to the air stream in front of said blade portion and to increase in diameter in the regions of said hub portion lying between the at least stub fan blades of said blade portion, said portions of said hub portion between said at least stub blades forming part of the air foil of said hub portion extending between said at least stub blades, and the portions of said hub portion downstream of said at least stub blades which are not exposed to the direct air stream through said fan wheel or the like and which are not part of the air foil formed by said hub portion having a contour which is substantially cylindrical, said wheel comprising a second ring member including segments for filling gaps downstream of said at least stub blades and forming part of the air foil of said hub, and means to secure said second ring member to said first hub and blade portion.

12. A fan wheel, pre-guide wheel or the like comprising a hub having a front end and a rear end, an annular flange extending from front to rear of said hub, said hub further having a frusto-conical outer wall extending radially outwardly from said annular flange at the front end thereof towards the back of said hub, said outer wall and said flange defining therebetween a generally V-shaped space as viewed in planes radial of said hub; and a plurality of at least stub fan blades all cast or molded integrally in one piece with said hub, said stub fan blades extending radially outwardly from said outer frusto-conical wall;

said hub comprising a cross-sectional area on the downstream side of said at least stub blades which is different from the cross-sectional area of the hub between said stub blades, said hub having a contour such that the hub diameter increases in the direction of air flow in the regions directly exposed to the air stream and in the regions lying between adjacent ones of said stub blades only, and in the regions axially aligned with and downstream of said stub blades said hub contour is substantially cylindrical as defined by said annular flange and said hub having no portions which increase in hub diameter in the portions of the hub axially aligned with and downstream of said blades.

13. A fan wheel or pre-guide wheel according to claim 12, wherein said frusto-conical wall is formed with gaps on the downstream air flow side of said fan blades, said annular flange being substantially cylindrical and defining said hub in the region of said gaps, segment means for filling said gaps, and said segment means having a contour matching the contour of said frusto-conical wall.

* * * * *